United States Patent [19]

Kawaguchi et al.

[11] 4,213,074

[45] Jul. 15, 1980

[54] THIN-FILM ELECTROLUMINESCENT DISPLAY PANEL SEALED BY GLASS SUBSTRATES AND THE FABRICATION METHOD THEREOF

[75] Inventors: Masashi Kawaguchi; Hiroshi Kishishita, both of Nara; Etsuo Mizukami; Yoshiharu Kanatani, both of Tenri, all of Japan

[73] Assignee: Sharp Kabushiki Kaisha, Osaka, Japan

[21] Appl. No.: 915,447

[22] Filed: Jun. 14, 1978

[30] Foreign Application Priority Data

Mar. 16, 1978 [JP] Japan ..... 53-30819

[51] Int. Cl.[2] ..... H05B 33/04; H05B 33/10

[52] U.S. Cl. ..... 313/509; 29/588; 313/232; 313/512

[58] Field of Search ..... 313/512, 509, 506, 232; 29/588

[56] References Cited

U.S. PATENT DOCUMENTS 3,166,687 1/1965 Veres ..... 313/512 X 3,393,337 7/1968 Panerai et al. ..... 313/509

3,398,322 8/1968 Guenther ..... 313/232 X

*Primary Examiner*—Palmer C. Demeo

*Attorney, Agent, or Firm*—Birch, Stewart, Kolasch and Birch

[57] ABSTRACT

A thin-film electroluminescent display panel is sealed by a pair of glass substrates for protecting itself from the environment. A protective liquid is introduced between a counter glass substrate and a substrate for supporting the electroluminescent display panel. The protective liquid comprises silicon oil or grease which assures the thin-film electroluminescent panel of preservation of the electroluminescent display panel. The counter glass substrate is bonded to the substrate through an adhesive of, for example, photocuring resin. A capillary tube is provided within the substrate for injecting the liquid under vacuum conditions. The counter glass substrate can be plate-shaped thereby eliminating a spacer. The liquid has the ability of spreading into pin holes generated on dielectric layers, and is resistant to high voltage, high humidity and high temperature, and is inert to layers constituting the thin-film electroluminescent display panel and has a small vapor pressure and a small coefficient of thermal expansion.

20 Claims, 9 Drawing Figures

THIN-FILM ELECTROLUMINESCENT DISPLAY PANEL SEALED BY GLASS SUBSTRATES AND THE FABRICATION METHOD THEREOF

BACKGROUND OF THE INVENTION

The present invention relates to an thin-film electroluminescent display panel and, more particularly, to a thin-film electroluminescent display panel shielded by a pair of glass substrates and a protective liquid disposed therebetween.

Firstly, a conventionally-shielded electroluminescnet display panel representative of the prior art is illustrated in FIG. 1, wherein the EL display panel comprises a first transparent glass substrate 1, a transparent electrode 2 made of $In_2O_3$, $SnO_2$ etc. formed thereon, a first dielectric layer 3 made of $Y_2O_3$, $TiO_2$, etc., an EL thin film 4 made of ZnS:Mn, and a second dielectric layer 5 made of a similar material of the first dielectric layer 3. A counter electrode 6 is made of Al and is formed on the second dielectric electrode 16 through evaporation techniques. The first dielectric layer 3 is provided by sputtering or electron beam evaporation techniques. The EL thin film 4 is made of a ZnS thin film doped with manganese at a desired amount. An AC electric field is applied to the transparent electrode 2 and the counter electrode 6 to activate the EL thin film 4.

An example of the above structure of the EL display panel was disclosed in, for example, U.S. Pat. No. 3,967,112 "PHOTO-IMAGE MEMORY PANEL AND ACTIVATING METHOD THEREOF" issued on June 29, 1976, assigned to the same assignee.

The first and the second dielectric layers 3, 5 contain inevitably a plurality of pin-holes and micro-cracks during the fabrication steps thereof. The EL thin film 4 is damaged by moisture passing through the pin-holes and the micro-cracks. Thus the EL thin film 4 produces heat owing to the loss of the electroluminescence and is damaged in its electro-optical properties.

FIG. 1 shows a protective structure for the EL display panel, wherein an insulating layer 8 is coated over the EL display panel, and furthermore, a layer of epoxy resin 9 is provided for shielding the insulating layer 8. This protective structure can result in eliminating the above defects. The insulating layer 8 comprises an insulating film made of $Si_3N_4$ or $Al_2O_3$. The insulating layer 8 is disposed over the EL display panel which is positioned on the substrate 1.

However, there are in the above protective structure critical defaults in that a plurality of pin-holes unfortunately appear in the insulating layer 8 and the epoxy resin 9 owing to fine dusts and alien substances. In accordance with the large sized EL display panel, it is very difficult to provide uniform and nondefective layers including the insulating layer 8 and the epoxy resin layer 9. Even if complete layers of the 8 and the epoxy resin layer 9 are achieved, the EL thin flim 4 is broken down when applied with an electric field because of the expansion of thermally-damaged regions of the EL thin film 4.

The insulating layer 8 and the epoxy resin 9 are subsequently damaged by heat. Moisture passes through the thermally-damaged regions into the EL display panel from the atmosphere to degrade the electro-optical properties of the EL display panel and eventually cause the distruction of the EL display panel. The existence of the moisture mainly lowers the intensity of the El light from the EL display panel.

Accordingly it is very difficult to produce complete and uniform layers suitable for a EL display panel, including the protective layers 8, 9 by the present fablication techniques.

OBJECTS AND SUMMARY OF THE INVENTION

Accordingly, it is a primary object of the present invention to provide a novel protective structure for a thin-film electroluminescent (EL) display panel.

It is a more specific object of the present invention to provide a novel seal method for a thin-film EL display panel.

Other objects and further scope of applicability of the present invention will become apparent from the detailed description given hereinafter. It should be understood, however, that the detailed description and specific examles, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a pair of substrates, at least one of which being a transparent glass substrate, are provided for sealing a conventional electroluminescent (EL) display unit, together with the use of a protective liquid for the EL display unit. A spacer is positioned for determining the pair of substrates. Injection holes are formed within the spacer to introduce the protective liquid into the cavity defined by the two substrates. An adhesive is adapted to provide the bonding between the pair of the substrates and the spacer. The protective liquid has the ability of flowing into the pin holes produced in the dielectric layers of the EL display unit, and is also resistant to high voltage, high humidity and high temperature, is inert to the layers constituting the EL display unit and has a small vapour pressure and small coefficient of thermal expansion.

The protective liquid is preferably selected to be silicon oil or grease etc. The spacer is selected to be a polyacetal resin or a polyimide resin or another type of insulating plastic. Silicon rubber and glass are applicable for use as the spacer. The adhesive is an epoxy resin and so like. A lead electrode for the EL display unit is extended toward the cavity defined by the two substrates. The lead electrode is coupled to a driver for applying an AC electric field into the EL display unit.

The protective structure for the EL display unit is completed in accordance with the following fabrication steps. At first, the EL display unit is disposed within the two substrates and the spacers which are bonded together by an adhesive, except for the portion of the injection holes. This composite is soaked within a suitable protective liquid, while heating at a suitable temperature of one hundred to two hundred degrees centigrade. Simultaneously, the package is placed under a pressure below $10^{-2}$ torr or a vacuum state and the cavity is fill with the protective liquid. After removing the composite under room temperature and atmospheric pressure conditions, the injection hole is sealed by an adhesive.

The spacer can be eliminated by the substitution of the counter substrate into a frosted glass substrate. This is because the EL display unit has the thickness of several hundred microns at most. The EL display unit can be entirely covered by a dent of the suitable frosted glass substrate.

A fiber means can be positioned within the cavity defined by the substrates so as to impregnate the protective liquid and cover the EL display unit. The fiber means is, for example, asbestos. The protective liquid is previously impregnated within the fiber means. This protective structure of the EL display unit is resistant to mechanical shocks.

In another form of the present invention, in addition to the plane substrate, only one plate-shaped counter glass substrate is provided for accommodating the EL display unit and the protective liquid, thereby eliminating the spacer.

A photo-curing resin is adapted to bond the plate-shaped counter glass substrate to the plane substrate. The plate-shaped counter glass substrate is approximately one mm deep, where the EL display unit is positioned with respect to the plane substrate. The injection hole is formed within the plate-shaped counter glass substrate for introducing the protective liquid into the cavity containing the EL display unit. The protective liquid is introduced into the cavity defined by the two substrate through the capillary phenomena. The injection hole is sealed by an adhesive after the injection of the protective liquid.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE PREFERRED EMBODIMENTS

Figure 1:
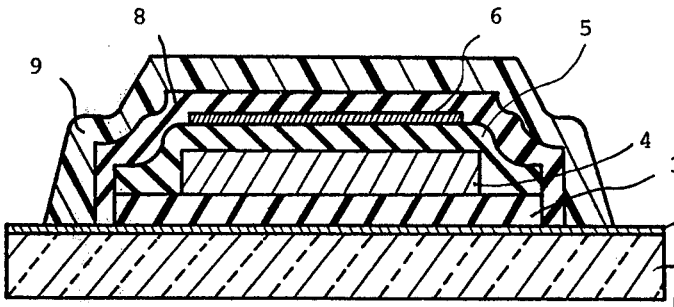
PRIOR ART FIG. 1
FIG. 1 is a cross-sectional view of a prior art thin-film electroluminescent (EL) panel.
Figure 2:
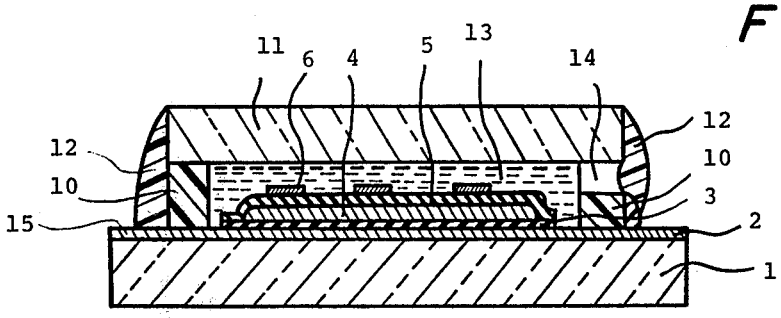
FIG. 2 is a cross-sectional view of a thin-film EL panel according to the present invention.

FIG. 2 shows a thin-film electroluminescent (EL) panel of the present invention. The thin-film EL panel comprises a transparent glass substrate 1, a plurality of transparent electrode 2 made of $In_2O_3$ or $SnO_2$ etc., a first dielectric layer 3, an EL thin film 4, a second dielectric layer 5, a plurality of counter electrodes 6 made of, for example, Al, spacers 10, and a counter substrate 11 made of glass. The transparent electrodes 2 are arranged on the glass substrate 1 in parallel with each other. The counter electrodes 6 are arranged so that they cross at a right angles relative to the transparent electrodes 2 in a plane view. A cross point between the transparent electrodes 2 and the counter electrodes 6 causes an element for the EL panel. An AC power energy is applied to the transparent electrodes 2 and the counter electrodes 6.

The first dielectric layer 3 comprises $Y_2O_3$, $TiO_2$, $Al_2O_3$, $Si_3N_4$, and $SiO_2$ etc. which is disposed by a sputtering technique or by electron beam evaporation. The EL thin film 4 is made of a ZnS thin film doped with manganese in a desired amount. The second dielectric layer 5 comprises a similar material as that of the first dielectric layer 3.

The EL panel has a sealing structure for the EL unit, namely, the first and the second dielectric layers 3, 5 and the EL thin film 4. The counter substrate 11 is provided for sealing the EL unit together with the transparent glass substrate 1. The counter substrate 11 is not required to be transparent because viewing as made from the substrate 1. The spacers 10 are positioned for determining the counter substrate 11. An adhesive 12 is coated for bonding the transparent glass substrate 1, the spacer 10, and the counter substrate 11. A protective liquid 13 is contained within a cavity defined by the two substrates 1 and 11. The protective liquid 13 functions to preserve the EL unit. The protective liquid 13 can be silicon oil or grease which are suitable for vacuum sealing.

It is preferable that the protective liquid 13 has the following properties:

(1) able of being penetrated into pin holes;
(2) resistant to a high voltage;
(3) resistant to considerable heat and humidity;
(4) inert with the material of the EL unit; and
(5) has a small vapour pressure and a small coefficient of thermal expassion.

The items (1), (2), and (4) are very important factors for the protective liquid 13.

The spacer 10 is an insulating prastic sheet made of a polyacetal resin or a polyimide resin, or a silicon rubber, glass plate. At least one injection hole 14 is formed within the spacer 10 for injecting the protective liquid at the periphery of the spacer 10. The adhesive 12 is an epoxy resin or the like. Lead terminals 15 of the transparent electrodes 2 and the counter electrodes 6 are formed on the transparent glass substrate 1 and extend toward the cavity. A control circuit (not shown) is coupled to the lead terminals 15 to apply the AC power energy to the EL unit.

The EL display panel shown in FIG. 2 is fabricated by the following manufacturing process. The EL unit is disposed on the transparent electrode 2 which is formed on the transparent glass substrate 1. The counter substrate 11 is positioned on the transparent glass substrate 1 so as to enclose the EL unit through the use of the spacer 10. The adhesive is coated over the two substrates 1 and 11, and the spacer 10 except where the injection hole 14 is located. The thus composed EL panel is soaked in a tank containing the protective liquid 13. The tank is heated at a temperature of one to two hundred degree centigrade while withdrawing the atmosphere by pumping under $10^{-2}$ torr. Air and gas contained within the cavity are removed therefrom and the protective liquid 13 can be replaced through the injection hole 14. The EL panel is removed under the conditions of room temperature and the atmospheric pressure. The injection hole 14 is sealed by the adhesive 12 to contain the protective liquid 13.

Under these circumstances, the air and gas are effectively removed out by means of a vacuum pump. The removement of the air and the gas is enhanced by heating of the tank. Also the flowability of the protective liquid 13 is increased by the heating. Complete impregnation of the protective liquid 13 into the pin holes is thus achieved.

A frosted glass substrate can be substituted for the counter substrate 11 in another form of the present invention, to thereby eliminate the spacer 10. The reason for this is that a dent in the frosted glass substrate can cover the EL unit having a thickness of about two hundred microns. The frosted glass substrate is directly bonded to the transparent glass substrate 1 at the periphery of the cavity defined by the frosted glass substrate and the transparent glass substrate 1.

A fiber means cn be disposed within the cavity defined by the two substrates 1 and 11. The fiber means impregnates the protective liquid 13 to continuously and completely cover the EL unit. Asbestos is preferable for the fiber means. Advantageously, the protective liquid is previously impregnated within the fiber means without injecting it through the injection hole 14 after the construction of the composite EL unit. Thus the sealed EL panel is resistant to mechanical shocks applied thereto.

Figure 3:
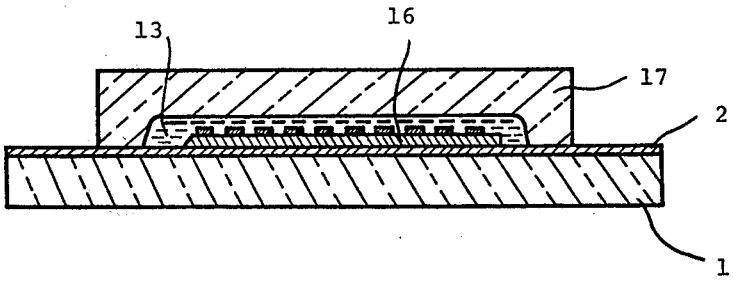
FIG. 3 is a cross-sectional view of a thin-film EL panel according to the present invention.

FIG. 3 illustrates another specific form of the EL panel according to the present invention, wherein an EL unit 16 is accommodated by the transparent glass substrate 1 and a plate-shaped glass substrate 17 together with the protective liquid 13. Like elements corresponding to those of FIG. 2 are represented by like numerals. The EL unit 16 includes the first and the second dielectric layers 3, 5, the EL thin film 4, and the counter electrodes 6 as shown in FIG. 2.

Figure 4:
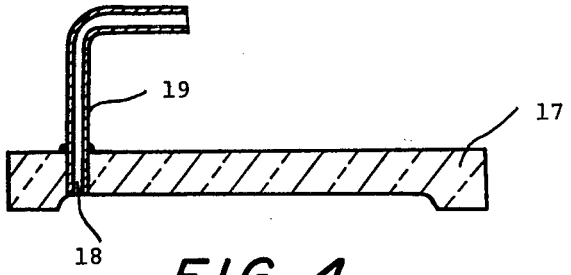
FIG. 4 is a cross-sectional view of a plate-shaped glass substrate and a tube adapted to the thin-film EL panel shown in FIG. 3.

The plate-shaped glass substrate 17 is tightly bonded by an adhesive of, for example, a photo curing resin, to the transparent glass substrate 1. The detail of the plate-shaped glass substrate 17 is illustrated in FIG. 4. The plate-shaped glass substrate 17 is made of a soda glass having a thickness of 3 mm. A dent 1 mm deep is formed within the plate-shaped glass substrate 17 for locating the EL unit through the use of the etching technique. An injection hole 18 is formed within the plate-shaped glass substrate 17 into which a pipe 19 is inserted for introducing the protective liquid 13 into the cavity defined by the plate-shaped glass substrate 17 and the transparent glass substrate 1. The pipe 19 is made of a metal and is tightly fixed in the injection hole 18.

The protective liquid 13 is injected into the cavity by the following steps illustrated by FIGS. 5(A), 5(B) and FIGS. 6(A), 6(B) and 6(C).

Figure 5A:
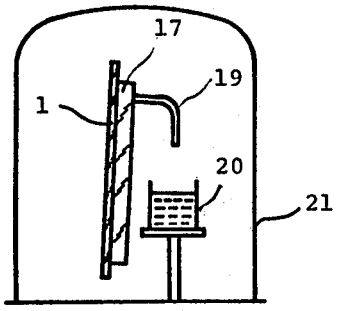
FIGS. 5(A) and 5(B) are side views of fabrication steps of the thin-film EL panel shown in FIG. 3.

The EL package comprising the transparent glass substrate 1, the plate-shaped glass substrate 17, and the EL unit is positioned within a vacuum chamber 21. A tank 20 containing the protective liquid 13 is also disposed within the vacuum chamber 21. The pipe 19 is firstly separated from the protective liquid 13, as shown in FIG. 5(A).

Figure 5B:
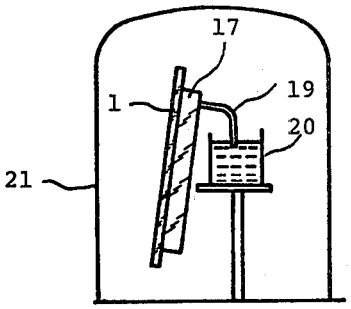

Under these circumstances, the gas within the vacuum chamber 21 is withdraw by a vacuum pump. While the chamber is being evacuated, the tip of the pipe 19 is placed within the protective liquid 13 as shown in FIG. 5(B). Thereafter, the vacuum chamber 21 is returned to atmospheric pressure. The protective liquid 13 contained within the tank 20 can be removed into the cavity through the pipe 19. The vacuum chamber 21 can be heated at a temperature of one hundred to two hundred degrees centigrade for the purpose of enhancing flowing properties of the protective liquid 13.

Figure 6A:
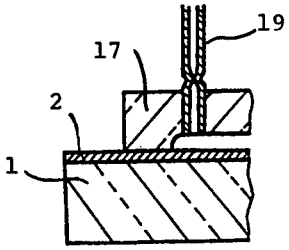
FIGS. 6(A) through 6(C) are cross-sectional views of the fabrication steps of the thin-film EL panel shown in FIG. 3.
Figure 6B:
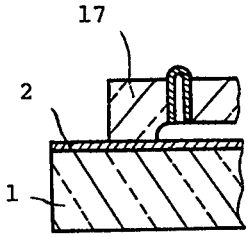
Figure 6C:
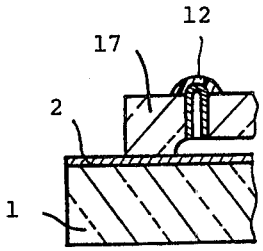

After the completion of the injection of the protective liquid 13 into the cavity chamber containing the EL device, the pipe 19 is sealed by a pressing bonding technique as shown in FIG. 6(A). The pipe 19 is then cut at the sealed portion as viewed from FIG. 6(B). An epoxy adhesive 12 is the coated over the pipe 19 for achieving a complete seal, as shown in FIG. 6(C).

In accordance with the present invention, the protective liquid 13 permeates into the pin holes to prevent the EL panel from being damaged by an increase in a small, thermally-damaged area. Moreover, moisture can be eliminated from the EL panel embodying the present invention.

No moisture is introduced into the cavity through the connection of the transparent glass substrate 1 and the plate-shaped counter substrate 11, where the adhesive is formed for protecting the EL panel according to the present invention.

While only certain embodiments of the present invention have been described, it will be apparent to those skilled in the art that various changes and modifications may be made therein without departing from the spirit and scope of the invention as claimed.

What is claimed is:

1. A thin-film electroluminescent element comprising:

a pair of substrates disposed to define a cavity therebetween;

a composite comprising a thin-film electroluminescent layer sandwiched between a pair of dielectric layers, said composite being disposed within said cavity, at least one of said pair of substrates being transparent to the light emitted by said electroluminescent layer when properly engaged;

a pair of opposing electrodes positioned to define said composite therebetween; and a protective liquid disposed within said cavity defined by said substrates and being in contact with the dielectric layers, said protective liquid being adapted to impregnate into pin holes caused in the dielectric layers, said protective liquid being inert with respect to the thin-film electroluminescent layer and the two dielectric layers, resistant to high voltage, high humidity, and high temperature, and having a small vapor pressure and a small coefficient of thermal expansion.

2. The thin-film electroluminescent element according to claim 1, wherein the protective liquid is a silicon oil.

3. The thin-film electroluminescent element according to claim 1, wherein the protective liquid is a grease.

4. The thin-film electroluminescent element according to claim 1, wherein the substrates comprise a pair of plane substrates, at least one of which is a transparent substrate.

5. The thin-film electroluminescent element according to claim 4, wherein at least one spacer means is provided between the pair of substrates for determining the position of the two substrates relative to each other and at least one hole is formed within the spacer means for introducing the protective liquid into the cavity.

6. The thin-film electroluminescent element according to claim 5, wherein an adhesive is further provided for combining the substrates and the spacer to one another.

7. The thin-film electroluminescent element according to claim 1, wherein the substrates comprise one transparent substrate and a frosted counter substrate.

8. The thin-film electroluminescent element according to claim 1, wherein a fiber means is further provided with said protective liquid, the fiber means covering the thin-film electroluminescent element.

9. The thin-film electroluminescent element according to claim 1, wherein the substrates comprise a transparent plane substrate and a plate-shaped substrate.

10. The thin-film electroluminescent element according to claim 9, wherein a pipe means is further provided within the plate-shaped substrate for introducing the protective liquid into the cavity.

11. A method for fabricating a thin-film electroluminescent element having a thin-film electroluminescent layer including an impurity serving as a luminescent center, a pair of dielectric layers deposited so as to sandwich said thin-film electroluminescent layer, and electrodes provided on each of said dielectric layers said method comprising:

positioning the thin-film electroluminescent element on a transparent plane substrate;

disposing a counter substrate relative to the transparent plane substrate in such a manner to define a cavity therebetween containing the thin-film electroluminescent element; and introducing a protective liquid for covering the thin-film electroluminescent element into said cavity, the protective liquid being adapted to penetrate into pin holes present in the dielectric layers.

12. The method according to claim 11, wherein at least one spacer is provided for determining the position of the transparent plate substrate relative to the counter substrate and further including the step of forming a hole in said spacer for introducing the protective liquid into the cavity.

13. The method according to claim 12, further including the steps of utilizing an adhesive for combining the transparent plane substrate, the counter substrate, and the spacer together, introducing the protective liquid into the cavity through the hole and then sealing the hole.

14. The method according to claim 11, wherein the method further includes heating the protective liquid to a temperature of one hundred to two hundred degrees centigrade.

15. The method according to claim 11, wherein the counter substrate has a plate-shape.

16. The method according to claim 11, wherein the counter substrate is a frosted substrate.

17. The method according to claim 11, wherein the method further includes positioning a fiber means containing the protective liquid within the cavity and arranging the fiber means so as to cover the thin-film electroluminescent element.

18. The thin-film electroluminescent element of claim 7, wherein the fiber means is asbestos.

19. The thin-film electroluminescent element of claim 1, wherein the dielectric layers completely enclose the thin-film electroluminescent layer.

20. The thin-film electroluminescent element of claim 1, wherein the electrodes are provided on each of the dielectric layers.

* * * * *